US005699772A

United States Patent [19]

Yonekawa et al.

[11] Patent Number: 5,699,772

[45] Date of Patent: Dec. 23, 1997

[54] FUEL SUPPLY SYSTEM FOR ENGINES WITH FUEL PRESSURE CONTROL

[75] Inventors: Masao Yonekawa, Kariya; Yoshihiro Majima, Obu; Makoto Miwa, Kariya; Kazuji Minagawa, Tokoname; Kiyotoshi Oi, Toyohashi, all of Japan

[73] Assignee: Nippondenso Co., Ltd., Kariya, Japan

[21] Appl. No.: 577,928

[22] Filed: Dec. 22, 1995

[30] Foreign Application Priority Data

Jan. 17, 1995 [JP] Japan ..... 7-005111
Jan. 26, 1995 [JP] Japan ..... 7-010937

[51] Int. Cl.[6] ..... F02M 37/04

[52] U.S. Cl. ..... 123/497; 123/516

[58] Field of Search ..... 123/497, 456, 123/516, 458

[56] References Cited

U.S. PATENT DOCUMENTS

| | | | |
|---|---|---|---|
| 4,982,331 | 1/1991 | Miyazaki | 12/497 |
| 5,044,344 | 9/1991 | Tuckey et al. . | |
| 5,085,193 | 2/1992 | Mirokawa | 123/497 |
| 5,148,792 | 9/1992 | Tuckey . | |
| 5,156,134 | 10/1992 | Tochizawa | 123/469 |
| 5,275,145 | 1/1994 | Tuckey | 123/516 |
| 5,359,976 | 11/1994 | Nakashimia | 123/516 |
| 5,373,829 | 12/1994 | Schuers | 123/516 |
| 5,379,741 | 1/1995 | Matysiewicz | 123/497 |
| 5,406,922 | 4/1995 | Tuckey | 123/497 |
| 5,426,971 | 6/1995 | Glidewell | 123/516 |
| 5,483,940 | 1/1996 | Namba | 123/497 |

FOREIGN PATENT DOCUMENTS

| | | |
|---|---|---|
| 4-232371 | 8/1992 | Japan . |
| 6-147047 | 5/1994 | Japan . |
| 6-173805 | 6/1994 | Japan . |

*Primary Examiner*—Carl S. Miller
*Attorney, Agent, or Firm*—Cushman, Darby & Cushman IP Group of Pillsbury Madison & Sutro LLP

[57] ABSTRACT

In a fuel supply system of an internal combustion engine, an actual fuel pressure Pf is measured by a differential pressure sensor and the actual fuel pressure Pf is averaged in a different degree to determine two kinds of values Pfs and Pft. The value Pfs is used to control the fuel pressure, while the value Pft is used to correct a pulse width. Then, a correction value Vfpci is determined according to the load applied to the engine and used in a feedback control to adjust a fuel discharge pressure of a fuel pump.

7 Claims, 12 Drawing Sheets

MAP OF Vfpci

| (ℓ/rev) Q/N \ N (rpm) | 500 | 1000 | | 6000 | 6500 | 7000 |
|---|---|---|---|---|---|---|
| 0.05 | ··· | ··· | | ··· | ··· | 0.5 |
| 0.1 | ⋮ | | | | | ⋮ |
| | | | | | | |
| 0.95 | ⋮ | | | | | ⋮ |
| 0 | 0.5 | ··· | | ··· | ··· | 3.0 |

FIG. 11A
FIG. 11B
FIG. 11C
FIG. 11D
FIG. 11E
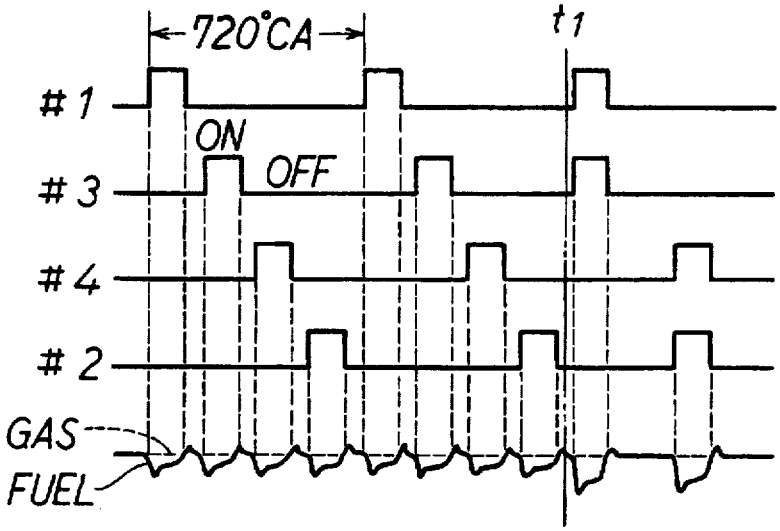
FIG. 11F
FIG. 11G
FIG. 11H
FIG. 11I
FIG. 11J
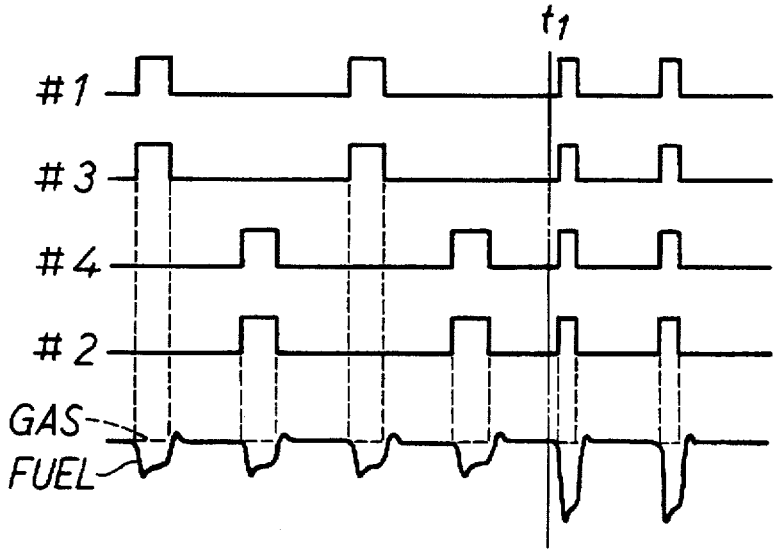
FIG. 11K
FIG. 11L
FIG. 11M
FIG. 11N
FIG. 11O
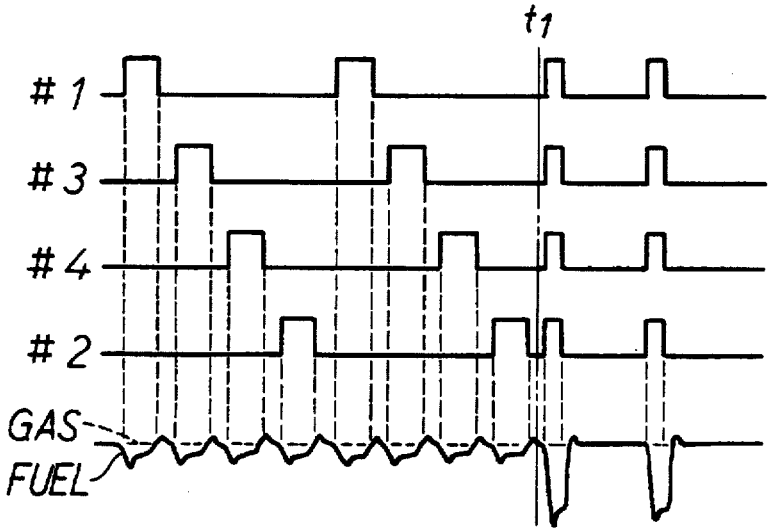

FIG. 15

INTAKE PRESSURE

| Q (m³/h) \ N (rpm) | 500 | 1000 | 1500 | 2000 |
|---|---|---|---|---|
| 5 | -70 kpa | -72 | -74 | -74 |
| 10 | -60 | -62 | -64 | -65 |
| | | | | |

FIG. 16

| INJECTION CHANGE (ℓ/h) | 0 | 5 | 10 | 15 | 20 |
|---|---|---|---|---|---|
| CORRECTION Vfpci | 0 | 0.2 | 0.4 | 0.6 | 0.8 |

FUEL SUPPLY SYSTEM FOR ENGINES WITH FUEL PRESSURE CONTROL

CROSS REFERENCE TO RELATED APPLICATIONS

This application is based on and claims priorities of Japanese Patent applications No. 7-5111 filed on Jan. 17, 1995 and No. 7-10937 filed on Jan. 26, 1995, the contents of which are incorporated herein by reference.

BACKGROUND OF THE INVENTION

1. Field of the Invention

The present invention relates to a fuel supply system of an engine having an improved mechanism for controlling the pressure of fuel to be fed under pressure from a fuel pump to an injector.

2. Description of Related Art

In fuel supply systems disclosed in Japanese Patent Publication Laid-open No. 6-50230 and U.S. Pat. No. 5,044,344, a voltage to be applied to a speed-variable motor for driving a fuel pump for feeding, under pressure, fuel stored in a fuel tank to an injector is adjusted by feedback control so that a fuel pressure detected by a fuel pressure sensor installed inside a fuel pipe and positioned immediately downstream the fuel pump becomes equal to a target fuel pressure.

In the fuel supply systems, the fuel pressure drops instantaneously when the fuel is injected from the fuel injector by applying pulses, as shown in FIGS. 17A and 17B. Such a fuel pressure fluctuation occurs instantaneously in a fuel supply system having no return pipe for returning a part of the fuel fed to the injector to the fuel tank.

In the above-described construction of the conventional fuel supply system, when such a fuel pressure drop is detected by the fuel pressure sensor, a higher voltage is applied to the speed-variable motor for driving the fuel pump under feedback control, according to the extent of the fuel pressure drop. It is to be noted that the fuel pressure drops instantaneously at the time of the injection of the fuel. Thus, the application of a high voltage to the speed-variable motor increases the fuel pressure higher than the original one, thus making the fuel pressure unstable. As a result, the actual amount of the fuel injected from the injector does not agree with a predetermined fuel injection quantity determined by calculation. As a result, the air-fuel ratio of air-fuel mixture deviates from a predetermined one.

In the above-described construction of the conventional fuel supply system, the fuel pressure sensor is positioned downstream of and in immediate proximity to the fuel pump and away from the injector. Hence, the pressure loss of a fuel pipe between the fuel sensor and the injector is comparatively great, thus causing a fuel pressure measured by the fuel sensor to deviate from a fuel pressure required at the injector. Further, in the conventional fuel supply systems, normally, a fuel filter is provided in the fuel pipe such that it is positioned downstream of the fuel sensor. The provision of the fuel filter leads to an increase in the pressure loss on the side downstream of the fuel pressure sensor. That is, the fuel pressure detected by the fuel sensor is greatly subjected to the influence of the pressure loss caused by the provision of the fuel filter. In particular, as shown in FIG. 18, the fuel filter causes the degree of the pressure loss to be varied, depending on the flow rate of the fuel. Further, the fuel filter is increasingly clogged with dust or the like with the elapse of time, thus increasing the pressure loss with age. That is, the provision of the fuel filter downstream of the fuel sensor makes it difficult to correctly measure the fuel pressure required at the injector.

In a fuel supply system disclosed in Japanese Patent Publication Laid-open No. 6-173805 proposed to overcome the above-described disadvantages, a fuel sensor is positioned downstream the fuel filter, and a pressure accumulator having a large capacity is provided inside the fuel pipe to absorb a fuel pressure fluctuation.

Although the pressure accumulator serves to reduce the fluctuation degree of the fuel pressure, the fuel pressure necessarily fluctuates due to a fuel injection. Thus, a stable injection quantity of the fuel cannot be ensured and hence the problem of the deviation of the air-fuel ratio from a predetermined one cannot be solved. Further, a fuel supply system having the pressure accumulator is costly and further, it is difficult to install the pressure accumulator having a comparatively great capacity inside an engine compartment having a small space.

In a fuel supply system disclosed in Japanese Patent Publication Laid-open No. 6-50230, based on an output signal of a fuel sensor for detecting the pressure of fuel inside a fuel supply line, a voltage to be applied to a fuel pump is controlled to adjust the pressure inside the fuel supply line to a predetermined value.

In this fuel supply system, there is a possibility that air enters the fuel supply line and mixes with the fuel while an engine is being manufactured or repaired and that the fuel is vaporized when the engine is driven at a high temperature with a high load being applied thereto. Air or the vapor inside the fuel supply line is injected together with the fuel through a fuel injector, thus making the air-fuel ratio lean.

SUMMARY OF THE INVENTION

It is therefore a primary object of the present invention to provide a fuel supply system uncostly and space-saved and capable of effectively preventing the injection quantity of fuel from deviating from a predetermined one.

It is a secondary object of the present invention to provide a fuel supply system capable of accurately detecting air which has entered a fuel supply line or vapor generated therein.

According to a first aspect of the present invention, a fuel pressure detector is located downstream a fuel filter to detect a fuel pressure with high accuracy without being affected by the influence of pressure loss generated by a fuel filter. A fuel pressure controller controls a speed-variable driving motor of a fuel pump by feedback, based on a value detected by the fuel pressure detector so that the fuel pressure coincides with a target fuel pressure. For example, if the fuel pressure is lower than the target pressure, the fuel pressure controller controls the speed-variable driving motor to increase the fuel pressure (discharge pressure of fuel pump), whereas if the fuel pressure is higher than the target pressure, it controls the speed-variable driving motor to decrease the fuel pressure. The fuel pressure controller changes a correction value to be used to control the speed-variable driving motor by feedback, according to a load applied to an engine. For example, if a great load is applied to the engine, a great correction value is set, whereas if a small load is applied to the engine, a small correction value is set. That is, due to a fuel injection, the greater the load applied to the engine is, the greater the drop degree of the fuel pressure is. Thus, the correction value to be used in the feedback control is altered, according to a variation in the load applied to the engine to improve the response performance in the control of the fuel pressure and stabilize the fuel pressure. A pulse width correction is made to the width of a pulse to be applied to the injector, according to the fuel pressure detected by the pressure detector. In this correction, if a pressure drop is detected, the pulse width correction increases the pulse width in accordance with the extent of the pressure drop, while if a pressure rise is detected, the pulse width correction decreases the pulse width in accordance with the extent of the pressure rise. That is, the pulse width correction prevents the injection quantity (air-fuel ratio) of the fuel from deviating from a predetermined one, because the pulse width correction prevents the injection quantity of the fuel from being subjected to the influence of a fluctuation in the fuel pressure.

Preferably, based on values determined by executing averaging processing of fuel pressure detected by the fuel pressure detector, the fuel pressure controller controls the speed-variable driving motor of the fuel pump to stabilize the fuel pressure, and the pulse width correction corrects the pulse width to secure a necessary injection quantity of the fuel. The averaging processing adopted to stabilize the fuel pressure and secure a necessary injection quantity of the fuel removes the influence of a fuel pressure fluctuation which occurs at a high frequency at the time of the fuel injection, thus providing a stable control of the fuel pressure and the injection quantity of the fuel.

More preferably, in executing the averaging processing of fuel pressures detected by the fuel pressure detector, the fuel pressures are averaged in different degrees to determine a value to be used to control the speed-variable driving motor of the fuel pump and a value to be used to correct the pulse width. This is to secure a stable control of the fuel pressure, based on the value to be used to control the speed-variable driving motor of the fuel pump and secure a necessary injection quantity of the fuel, based on the value to be used to correct the pulse width. In order to secure a necessary injection quantity of the fuel, it is necessary to promptly change the pulse width, according to a fluctuation in the fuel pressure. In this manner, the fuel pressure controller executes a stable control of the fuel pressure, and the pulse width correction executes a stable control of the injection quantity of the fuel.

Still more preferably, a fuel pipe extends from a fuel tank and terminates with a delivery pipe for distributing the fuel to the injector. That is, the fuel supply system is not provided with a return pipe for returning a part of the fuel fed to the injector to the fuel tank, thus allowing the fuel supply line to have a simple construction. Thus, the fuel supply system according to the present invention is space-saved and uncostly. Although the fuel supply system is not provided with the return pipe, the injection quantity of the fuel can be prevented from being subjected to the influence of a fluctuation in the fuel pressure, owing to a stable feedback control of the fuel pressure and a reliable control of the injection quantity of the fuel.

According to a second aspect of the present invention, a fuel supply system feeds fuel to a fuel injection valve via a predetermined fuel supply line. A fuel injector injects the fuel supplied thereto via the fuel supply line to each cylinder of the engine by opening and closing the fuel injection valve synchronously with the rotation of the internal combustion engine. A fuel pressure detector detects the pressure of the fuel present inside the fuel supply line. In this construction, a pressure fluctuation amount of a pressure detected by the fuel pressure detector is calculated when the fuel injection valve of the injector is opened or closed.

When the fuel injection valve is opened and the fuel injection starts, the fuel pressure inside the fuel supply line drops instantaneously, whereas when the fuel injection valve is closed and the fuel injection terminates, the fuel pressure inside the fuel supply line rises instantaneously. Such a fluctuation amount of the pressure is calculated.

When gas is present inside the fuel supply line, the pressure fluctuation is absorbed by the gas. Consequently, the pressure inside the fuel supply line fluctuates slightly. It is determined whether or not gas is present in the fuel supply line, based on the fluctuation amount of the pressure determined by the pressure fluctuation calculation. Thus, the presence of the gas in the fuel supply line can be accurately detected.

Preferably, when it is determined that gas is present inside the fuel supply line, the fuel supply system increases the pressure of the fuel. As a result, the pressure of the fuel inside the fuel supply line rises. The pressure rise allows vapor to be liquefied easily and air to be dissolved in the fuel easily. Consequently, air or vapor can be promptly discharged through the fuel injection valve together with the fuel.

In this manner, the gas present in the fuel supply line can be discharged therefrom promptly. Thus, the drive state of the engine can be returned to the normal state in a short period of time.

Preferably, the fuel supply system is provided with a plurality of fuel injection valves. When gas is present in the fuel supply line, the fuel injection system increases the number of the fuel injection valves which are opened simultaneously. As a result, the pressure of the fuel drops greatly when the fuel injection valves are opened. Consequently, air or vapor can be promptly discharged through the fuel injection valve together with the fuel.

In this manner, the gas present in the fuel supply line can be discharged therefrom promptly. Thus, the drive state of the engine can be returned to the normal state in a short period of time.

BRIEF DESCRIPTION OF THE DRAWINGS

These and other objects and features of the present invention will become apparent from the following description taken in conjunction with the preferred embodiments thereof with reference to the accompanying drawings throughout which like parts are designated by like reference numerals, and in which:

FIGS. 5A1 through 5C2 are time charts showing the behavior of an actual fuel pressure inside a fuel supply line in accordance with the first embodiment;

FIGS. 11A through 110 are time charts showing fuel pressure fluctuations according to injection methods in accordance with the second embodiment;

FIG. 15 is a table showing a two-dimensional map, in accordance with the fourth embodiment, for determining a pressure inside an intake pipe, based on an intake air quantity and an engine speed;

FIG. 16 is a table showing a one-dimensional map, in accordance with the fourth embodiment, for finding a correction value Vfpci, depending on a variation in a fuel injection quantity;

DETAILED DESCRIPTION OF THE PREFERRED EMBODIMENTS

Figure 1:
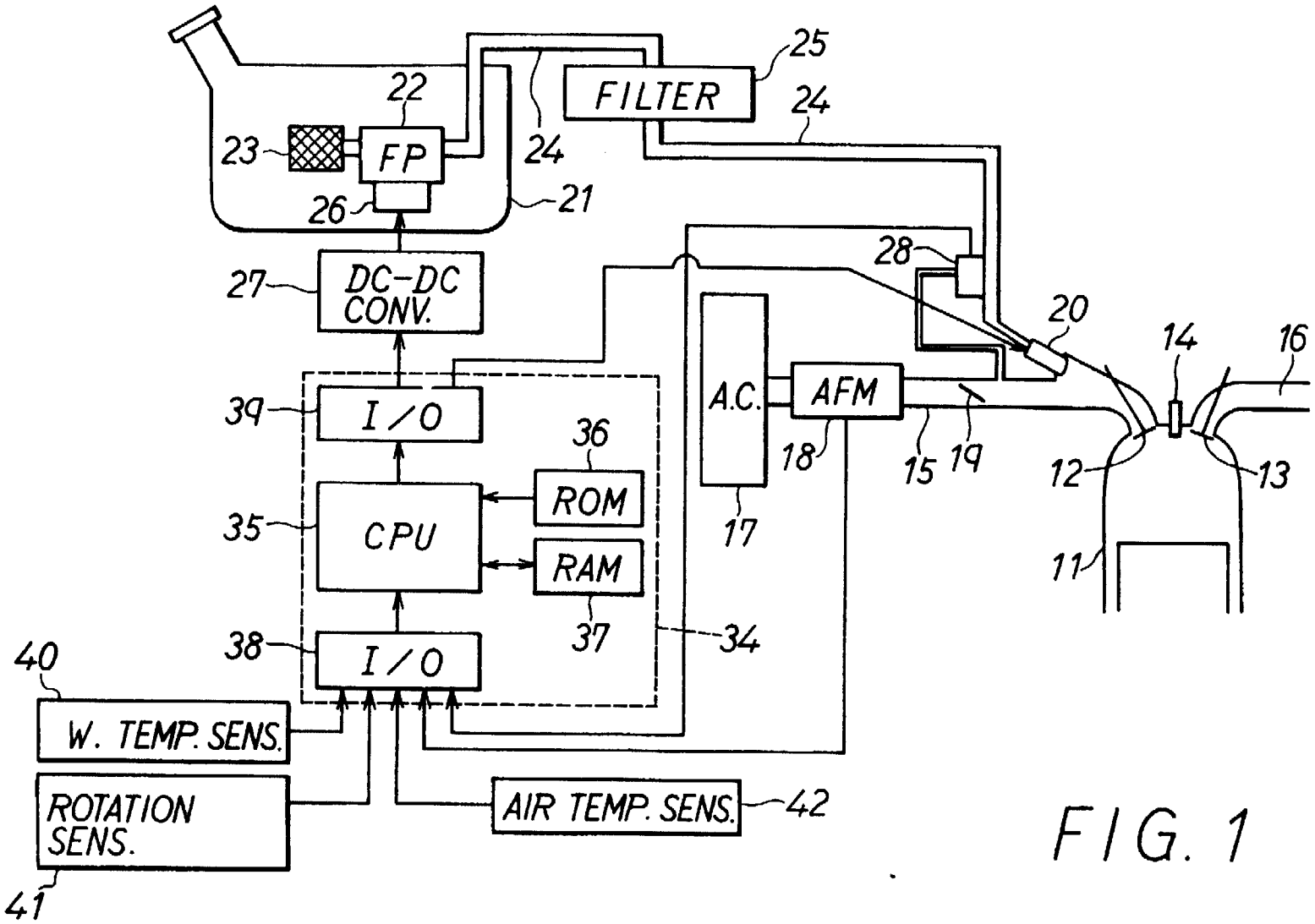
FIG. 1 is a schematic block diagram showing the construction of an entire fuel supply system in accordance with a first embodiment of the present invention.

A fuel supply system of an engine in accordance with the first embodiment of the present invention is described below with reference to FIGS. 1 through 9.

An internal combustion engine 11 having a plurality of cylinders comprises an intake valve 12, an exhaust valve 13, and an ignition plug 14. An intake pipe 15 and an discharge pipe 16 are connected with the internal combustion engine 11. An air cleaner 17 is installed upstream the intake pipe 15. An air flow meter 18 for detecting a flow rate of air which has passed through the air cleaner 17 is located downstream the air cleaner. A throttle valve 19 is provided inside the intake pipe 15. An injector 20 is mounted on the intake pipe 15 such that the air flow meter 18 is positioned upstream the throttle valve 19 and that the throttle valve 19 is positioned upstream the injector 20.

A fuel tank 21 for storing fuel accommodates a fuel pump 22 for feeding the fuel under pressure to the injector 20 and a fuel filter 23 positioned on the inlet side of the fuel pump 22. A fuel pipe 24 connects the discharge port of the fuel pump 22 and the injector 20 with each other. A fuel filter 25 mounted inside the fuel pipe 24 is positioned downstream the fuel tank 21. There is provided, between the fuel filter 25 and the injector 20, a differential pressure sensor 28 serving as a means for detecting the pressure difference between a fuel pressure inside the fuel pipe 24 and a pressure inside the intake pipe 15. The fuel pipe 24 has a nonreturn construction. That is, the fuel pipe 24 extends from the fuel tank 21 and terminates with a delivery pipe for distributing the fuel to the injector 20. In order to control the discharge pressure of the fuel pump 22, a DC—DC converter 27 is used to vary a voltage to be applied to a speed-variable DC motor 26 for driving the fuel pump 22.

An electronic control circuit 34 comprises a microcomputer having a CPU 35, a ROM 36, a RAM 37, and input/output interfaces 38 and 39. The electronic control circuit 34 reads information outputted thereto from a water temperature sensor 40 for detecting the temperature of engine-cooling water, a rotation sensor 41 for detecting the crank angle of each cylinder of the engine 11, an intake air temperature sensor 42 for detecting the temperature of intake air, the air flow meter 18, and the differential pressure sensor 28, thus controlling the operation of the injector 20 and the DC motor 26 of the fuel pump 22.

If the electronic control circuit 34 decides that a fuel pressure detected by the differential pressure sensor 28 is less than a target fuel pressure, i.e., if it is necessary to increase the discharge flow rate of the fuel pump 22. Therefore, the electronic control circuit 34 outputs a control signal to the DC—DC converter 27 so that a high voltage is applied to the DC motor 26 therethrough. If the electronic control circuit 34 decides that the fuel pressure detected by the differential pressure sensor 28 is greater than the target fuel pressure, i.e., if it is necessary to decrease the discharge flow rate of the fuel pump 22. Therefore, the electronic control circuit 34 outputs a control signal to the DC—DC converter 27 so that a low voltage is applied to the DC motor 26 therethrough.

Figure 2:
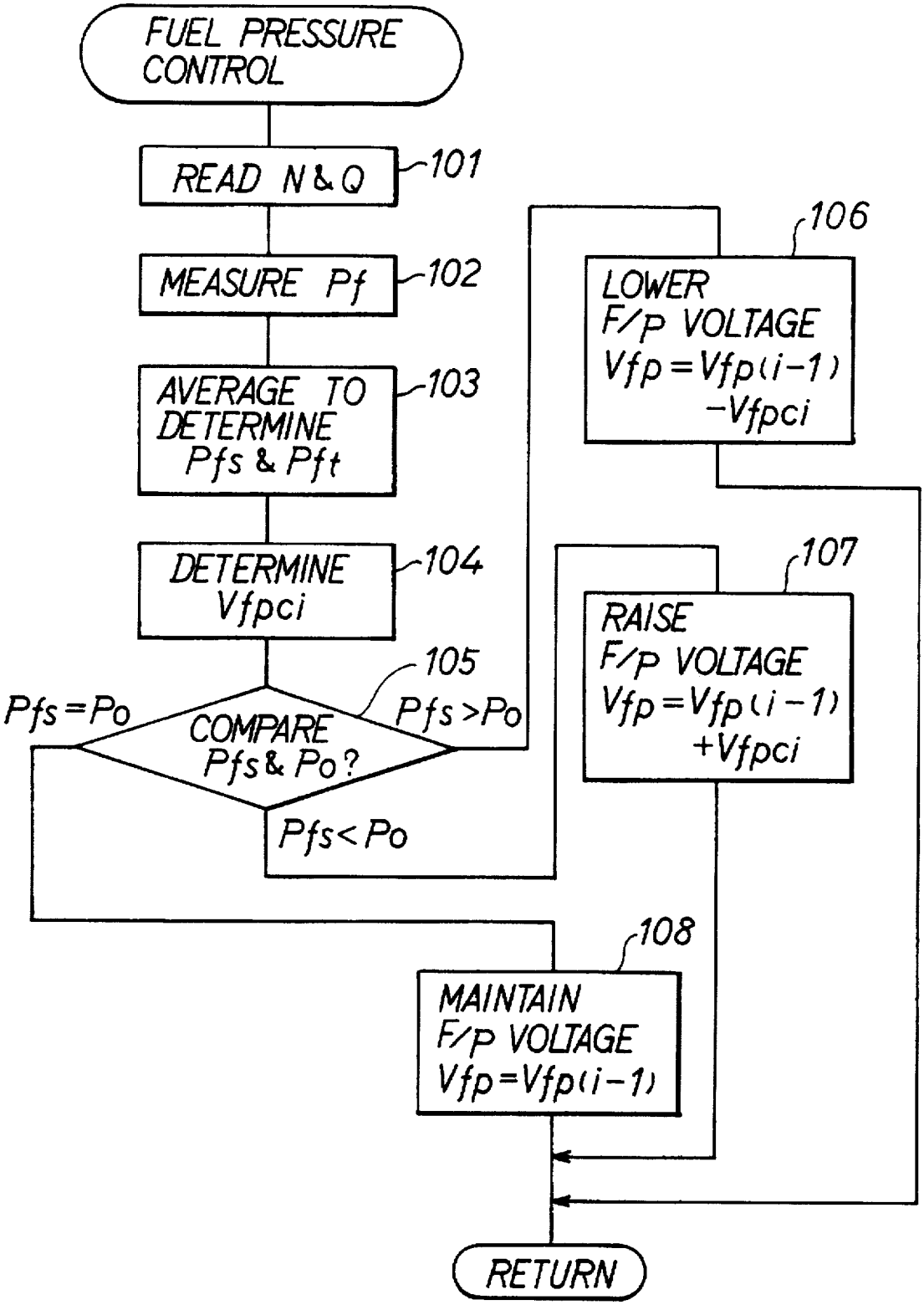
FIG. 2 is a flowchart showing the flow of the processing to be executed based on a fuel pressure-control routine.

The fuel pressure is controlled, based on a fuel pressure control routine shown in FIG. 2. The electronic control circuit 34 executes the processing of the fuel pressure control routine shown in FIG. 2 repeatedly at an interval of a predetermined time period. Upon start of the fuel pressure control, at step 101, the electronic control circuit 34 reads a signal indicating a load applied to the engine 11. In the first embodiment, as the signal indicating the load applied to the engine 11, the electronic control circuit 34 reads a signal indicating an engine speed (N) detected by the rotation sensor 41 and a signal indicating an intake air quantity (Q) detected by the air flow meter 18. As the signal indicating the load applied to the engine 11, it is also possible to use a signal indicating the pressure inside the intake pipe 15 and a signal indicating the open degree of the throttle valve 19. At step 102, the differential pressure of the sensor 28 is read, namely, a fuel pressure Pf is measured. At step 103, averaging processing of the actual fuel pressures Pf is executed to remove the influence of a fuel pressure fluctuation which occurs at a high frequency at the time of a fuel injection. The actual fuel pressures Pf are averaged in different degrees to determine two kinds of values Pfs and Pft. The averaged value Pfs is used to control the fuel pressure, namely, to control the voltage to be applied to the DC motor 26 of the fuel pump 22, whereas the averaged value Pft is used to correct a pulse width at step 205 of a pulse width calculation routine, shown in FIG. 3, which will be described later. Equations shown below are used to execute the averaging processing.

$$Pfs(i)=\{k1\times Pfs(i-1)+(256-k1)\times Pf\}+256$$

$$Pft(i)=\{k2\times Pft(i-1)+(256-k2)\times Pf\}+256$$

where k1 and k2 are constants; Pf is the actual fuel pressure; (i) indicates a value determined at a current time-execution of the routine; and (i−1) indicates a value determined at the preceding time-execution of the routine. The constant k1 is equal to or greater than the constant k2 so as to obtain the value Pfs by averaging the actual fuel pressures Pf in a less fine degree and obtain the value Pft by averaging them in a fine degree. This is to secure a stable control of the fuel pressure, based on the value Pfs and secure a necessary injection quantity of fuel, based on the value Pft. In order to secure a necessary injection quantity of fuel, it is necessary to promptly change the pulse width, according to a fluctuation in the fuel pressure.

After the values Pfs and Pft are determined by conducting the averaging processing of the actual fuel pressure Pf as described above, the program goes to step 104 at which a correction value Vfpci of feedback control to be made to adjust the fuel pressure is determined according to the load applied to the engine 11. The correction value Vfpci is determined by using a three-dimensional map shown in FIG. 4. Normally, the higher the engine speed (N) is and the greater the load applied to the engine 11 (ratio of intake air quantity (Q) to engine speed (N)) is, the greater the correction value Vfpci is. This is because when the same change occurs in the pulse width in a state in which the engine speed (N) is high and a high load is applied to the engine 11 and in a state in which the engine speed (N) is low and a low load is applied thereto, the degree of change in the injection quantity of the fuel in the former state is greater than that in the latter state and the speed of the fuel pressure drop in the former state is higher than that in the latter state.

At step 105, the averaged value Pfs is compared with a target fuel pressure Po. Depending on the result of the comparison between the averaged value Pfs and the target fuel pressure Po, the program goes to step 106, 107 or 108. Although the target fuel pressure Po is a value predetermined in the fuel supply system, it may be set to a variable value in dependence on the temperature of the fuel or the load applied to the engine 11. If it is decided at step 105 that the averaged value Pfs is equal to the target fuel pressure Po, i.e., if it is unnecessary to correct the fuel pressure, the program goes to step 108 at which a value determined as the voltage to be applied to the DC motor 26 at the preceding execution time of the routine is maintained. Then, the electronic control circuit 34 terminates the execution of the routine. If it is decided at step 105 that the averaged value Pfs is smaller than the target fuel pressure Po, i.e., if it is necessary to increase the fuel pressure, the program goes to step 107 at which the correction value Vfpci is added to a value Vfp(i−1) determined as the voltage to be applied to the DC motor 26 in the preceding execution time so as to increase a voltage Vfp to be applied to the DC motor 26. Then, the electronic control circuit 34 terminates the execution of the routine. If it is decided at step 105 that the averaged value Pfs is greater than the target fuel pressure Po, i.e., if it is necessary to decrease the fuel pressure, the program goes to step 106 at which the correction value Vfpci is subtracted from the value Vfp(i−1) calculated as the voltage to be applied to the DC motor 26 in the preceding execution time so as to decrease the voltage Vfp to be applied to the DC motor 26. Then, the electronic control circuit 34 terminates the execution of the routine.

Figure 3:
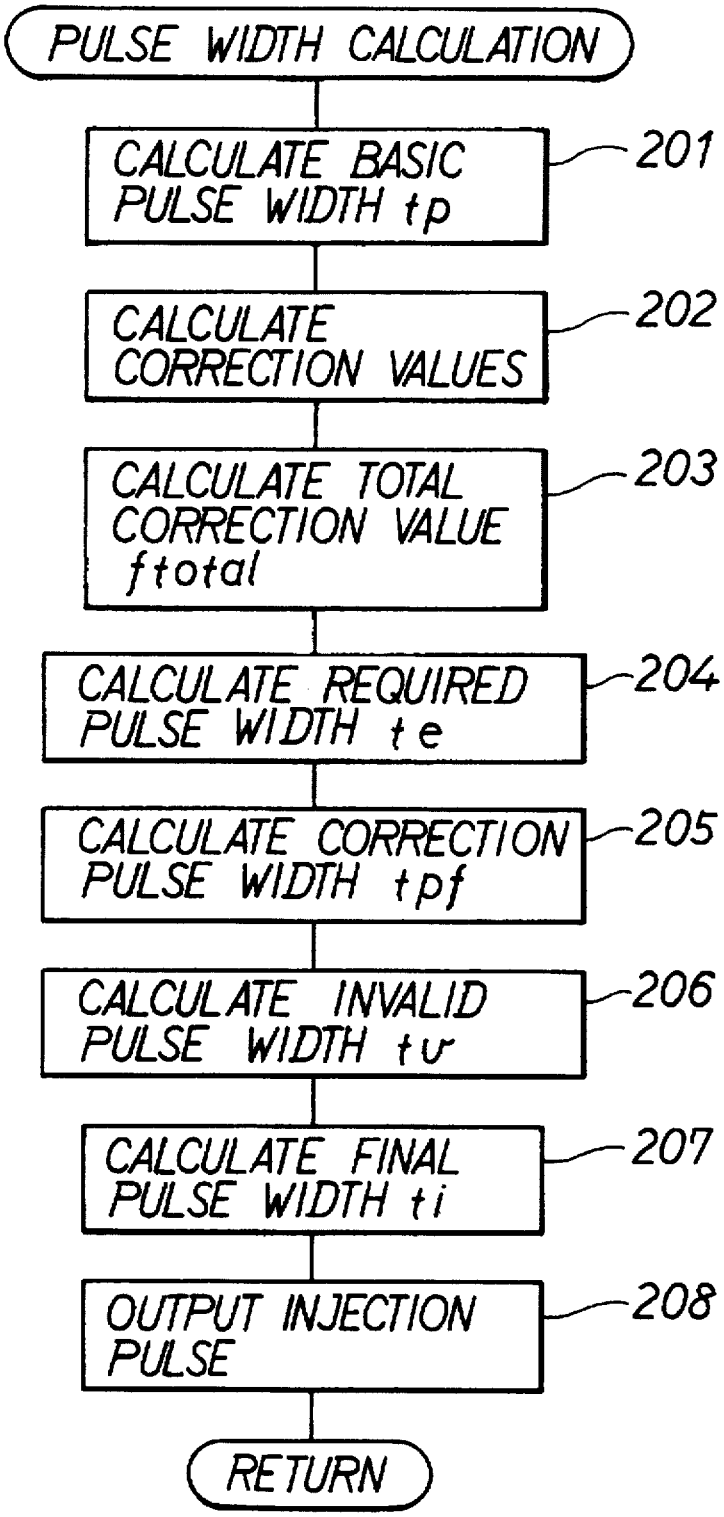
FIG. 3 is a flowchart showing the flow of the processing to be executed based on a pulse width calculation routine.

With reference to FIG. 3, description is made on a fuel injection pulse width calculation routine for calculating the width of the pulse to be applied to the injector 20. This routine is repeatedly executed synchronously with a signal, indicating the engine rotation, outputted from the rotation sensor 41. Upon start of the execution of the pulse width calculation processing, at step 201, a basic pulse width tp is calculated, based on an intake air quantity detected by the air flow meter 18 and the engine speed detected by the rotation sensor 41. The basic pulse width tp may be calculated, based on the pressure of air inside the intake pipe 15 and the engine speed or based on the open degree of the throttle valve 19 and the engine speed. Then, at step 202, various correction values for correcting the basic pulse width tp are calculated. The correction values include a warp-up correction value corresponding to the output of the water temperature sensor 40, a correction value for an acceleration drive or a deceleration drive, a correction value required to attain a stoichiometric air-fuel ratio in the feedback control, and the like. At step 203, the total correction value, ftotal, is calculated.

At step 204, an equation shown below is used to calculate a required pulse width te, based on the basic pulse width tp and the total correction value ftotal:

$$te=tp\times ftotal$$

At step 205, the required pulse width te is corrected, based on the averaged value Pft determined at step 103 of the fuel pressure control routine, according to the actual fuel pressure Pf. This is because the required pulse width te is determined, assuming that the fuel pressure is equal to the target fuel pressure. An equation shown below is used to determine a correction pulse width tpf.

$$tpf=(Pft/Po)^{1/2}\times te$$

Then, at step 206, an invalid pulse width tv is calculated. A two-dimensional map is used to determine the invalid pulse width tv, according to a battery voltage and the averaged value Pft. Then, at step 207, a final pulse width ti is determined by using an equation shown below.

$$ti=tpf+tv$$

where tpf is the correction pulse width, and tv is the invalid pulse width.

At step 208, an injection pulse is outputted from the electronic control circuit 34 to the injector 20, based on the final pulse width ti. Then, the electronic control circuit 34 terminates the execution of this routine.

Description is made on processing for detecting whether or not air has entered into the fuel pipe 24 or fuel therein has vaporized and on processing to be executed in correspondence to the result of the gas detection processing.

The behavior of the actual fuel pressure Pf inside the fuel pipe 24 at the time when gas is not present in the fuel pipe 24 is as shown in FIG. 5A1. That is, upon start of a fuel injection (pulse: OFF→ON) in FIG. 5A2, the actual fuel pressure Pf drops instantaneously. This is because liquid fuel is uncompressible and thus pressure which has dropped at the fuel injection remains as it is. Upon completion of the fuel injection, (pulse: ON→OFF), the actual fuel pressure Pf rises instantaneously because a fuel injection valve is closed rapidly. The behavior of the fuel pressure inside the fuel pipe 24 at the time when gas is present in the fuel pipe 24 is as shown in FIG. 5B1. That is, the fuel pressure is almost constant or changes slightly even at the time of ON-OFF changes in the pulse shown in FIG. 5B2. This is because air or vapor is compressible and thus it absorbs a pressure fluctuation.

Figure 6:
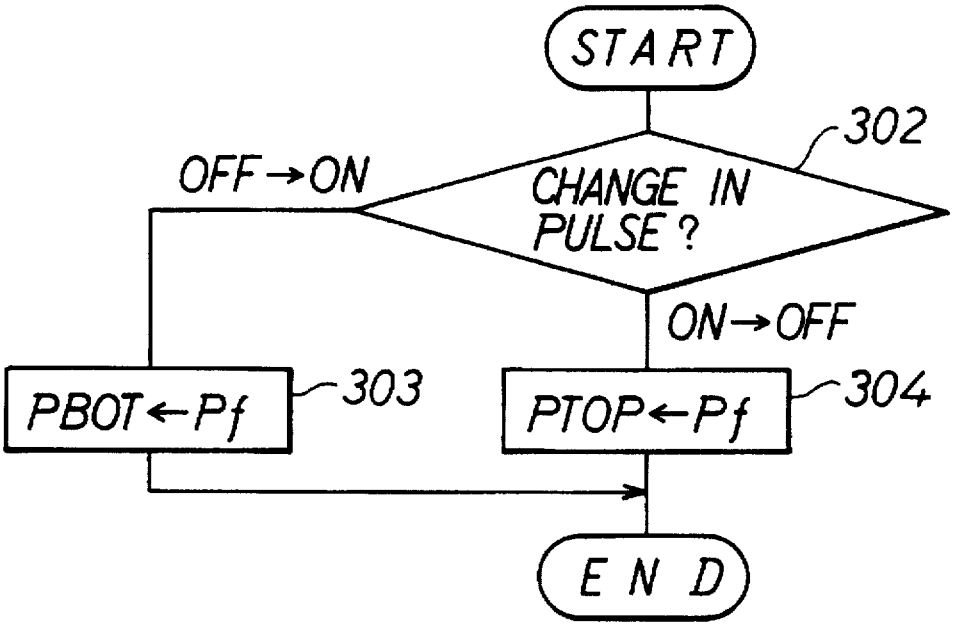
FIG. 6 is a flowchart showing processing for calculating a fuel pressure at a rise time and a fuel pressure at a drop time in gas detection processing in accordance with the first embodiment.
Figure 7:
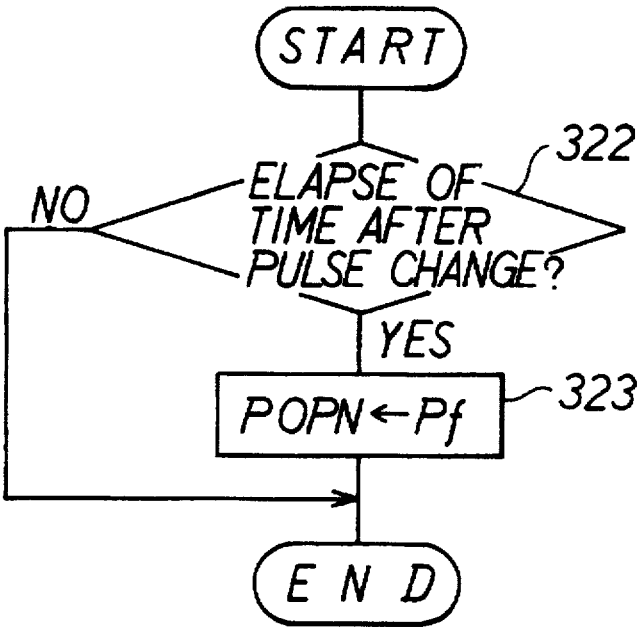
FIG. 7 is a flowchart showing processing for calculating a fuel pressure at a normal time in the gas detection processing in accordance with the first embodiment.
Figure 8:
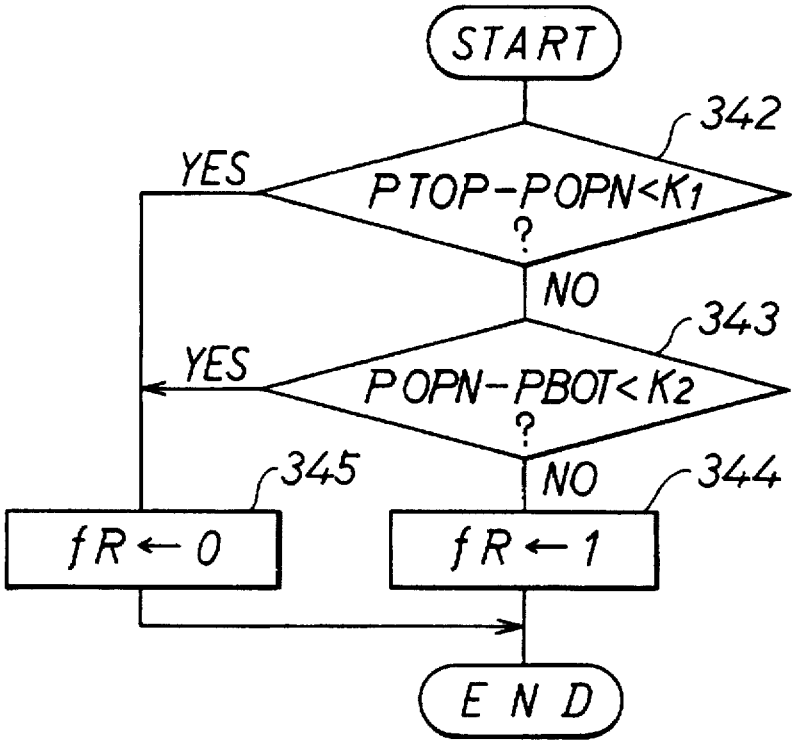
FIG. 8 is a flowchart showing processing for deciding whether or not gas is present in a gas supply line in the gas detection processing in accordance with the first embodiment.

FIGS. 6 through 8 are flowcharts showing gas detection processing for deciding whether or not air or vapor is present in the fuel pipe 24, by utilizing the above-described characteristic behavior of the fuel pressure inside the fuel pipe 24. The processing shown in FIG. 6 is executed as an interruption routine at the timing from OFF (injection valve is closed) of the pulse to ON (injection valve is opened) thereof or at the timing from ON to OFF thereof.

Upon start of the gas detection processing, at step 302, the electronic control circuit 34 decides whether or not an interruption has occurred at the timing of OFF→ON of the pulse or at the timing of ON→OFF thereof. If it is decided at step 302 that the interruption has occurred at the timing of OFF→ON of the pulse, the program goes to step 303 at which the detected actual fuel pressure Pf is substituted for a drop-time fuel pressure PBOT. Then, the electronic control circuit 34 terminates the processing. If it is decided at step 302 that the interruption has occurred at the timing of ON→OFF of the pulse, the program goes to step 304 at which the detected actual fuel pressure Pf is substituted for a rise-time fuel pressure PTOP. Then, the electronic control circuit 34 terminates the processing.

In addition to the above processing, the electronic control circuit 34 executes processing shown in FIG. 7 repeatedly at an interval of a predetermined time period or at an interval of a predetermined number of rotations of the engine 11. This processing is executed to determine a normal-time fuel pressure POPN, namely, a fuel pressure not at the start time of injection or termination time thereof, namely except for the time when the pulse changes from OFF to On or from ON to Off.

Upon start of the processing, it is decided at step 322 whether or not a predetermined time period (one–several milliseconds) has elapsed after the pulse is turned ON or OFF so as to check whether there is a possibility that the actual fuel pressure Pf is fluctuating due to the fuel injection in the predetermined time period after the pulse is turned ON or OFF.

If YES at step 322, the program goes to step 323 at which the detected actual fuel pressure Pf is substituted for the normal-time fuel pressure POPN. Then, the electronic control circuit 34 terminates the processing. If NO at step 322, the electronic control circuit 34 terminates the processing without changing the normal-time fuel pressure POPN, because there is a possibility that the detected actual fuel pressure Pf is still fluctuating.

In addition to the above-described processings, the electronic control circuit 34 executes processing shown in FIG. 8 repeatedly at an interval of a predetermined time period or at an interval of a predetermined number of rotations of the engine 11. This processing is executed to decide whether or not gas is present in the fuel pipe 24, based on results calculated in the processings shown in FIGS. 6 and 7.

Upon start of the gas detection processing, it is decided at step 342 whether or not the value of PTOP–POPN is smaller than a predetermined value $K_1$. If YES, i.e., if gas is present in the fuel pipe 24, the program goes to step 345 which will be described later. The predetermined value $K_1$ is set to be greater than the fluctuation amount of the actual fuel pressure Pf detected at the time when the fuel injection has terminated (pulse: ON→OFF) in the presence of gas in the fuel pipe 24 and smaller than the fluctuation amount of the actual fuel pressure Pf in the absence of gas in the fuel pipe 24.

If NO at step 342, the program goes to step 343 at which it is decided whether or not the value of POPN–PBOT is smaller than a predetermined value $K_2$. If YES at step 343, i.e., if the electronic control circuit 34 decides that gas is present in the fuel pipe 24, the program goes to step 345 which will be described later. The predetermined value $K_2$ is set to be greater than the fluctuation amount of the actual fuel pressure Pf at the time when the fuel injection has started (pulse: OFF→ON) in the presence of gas in the fuel pipe 24 and smaller than the fluctuation amount of the actual fuel pressure Pf in the absence of gas in the fuel pipe 24.

If NO at step 343, it can be decided that gas is not present in the fuel pipe 24. Then, the program goes to step 344 at which a flag fR indicating the absence of gas is set to "1". Then, the electronic control circuit 34 terminates the processing. If YES at step 342 or 343, there is a possibility that gas is present in the fuel pipe 24. Thus, at step 345, the electronic control circuit 34 sets the flag fR to "0". Then, the electronic control circuit 34 terminates the processing.

There is a possibility that the rise-time fuel pressure PTOP and the drop-time fuel pressure PBOT are measured when they are not at peak values of the fuel pressure. Thus, it is possible to set the flag fR to "0" when conditions of both steps 342 and 343 are satisfied or when the conditions of both steps 342 and 343 are satisfied at a plurality of times. It is also possible to decide whether or not gas is present in the fuel pipe 24, based on whether the value of PTOP–POPN is smaller than the predetermined value $K_1$ or on whether the value of POPN–PBOT is smaller than the predetermined value $K_2$.

Figure 9:
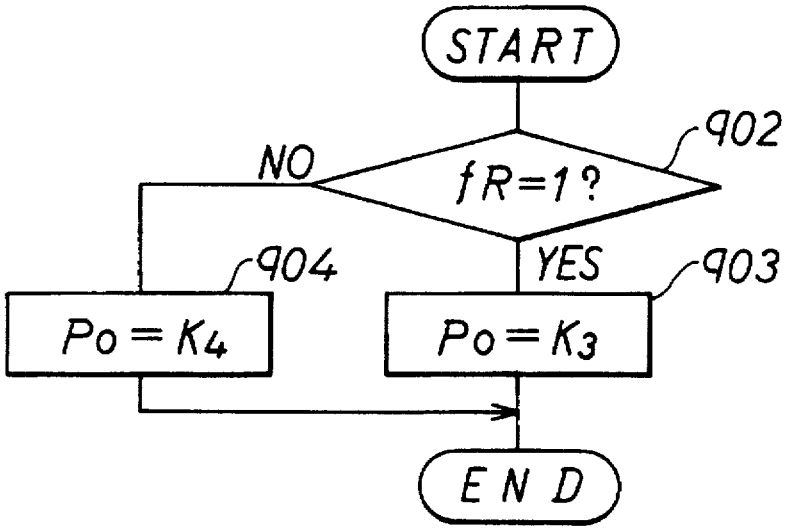
FIG. 9 is a flowchart showing a target fuel pressure-setting processing in accordance with the first embodiment.

In the first embodiment, based on the presence and absence of gas in the fuel pipe 24 detected by the above processing, the following control is executed. FIG. 9 is a flowchart showing processing for setting the target fuel pressure Po, based on detection of the presence and absence of gas in the fuel pipe 24. The electronic control circuit 34 executes processing shown in FIG. 9 repeatedly at an interval of a predetermined time period or at an interval of a predetermined number of rotations of the engine 11.

Upon start of processing, it is decided at step 902 whether or not the flag fR is set to "1". If YES, the program goes to step 903, whereas if NO, the program goes to step 904. At step 903, the target fuel pressure Po is set to $K_3$ predetermined in the absence of gas in the fuel pipe 24. At step 904, the target fuel pressure is set to $K_4$ predetermined in the presence of gas in the fuel pipe 24. The target fuel pressure $K_3 \leqq$ target fuel pressure $K_4$. More specifically, $K_3$ is 200–300 KPa, and $K_4$ is 300–400 KPa. This is because by setting the fuel pressure at the time when gas is present in the fuel pipe 24 to be higher than that at the time when gas is not present therein, air can be dissolved easily in the fuel or vapor can be liquefied easily and hence, air or vapor can be promptly discharged through the injector 20 together with the fuel. The target fuel pressures $K_3$ and $K_4$ may be set as variable values in the range of $K_3 \leqq K_4$, depending on the load applied to the engine 11.

The construction of the fuel supply system in accordance with the first embodiment allows gas present in the fuel pipe 24 to be accurately detected and also allows air or vapor to be discharged therefrom promptly together with the fuel, thus returning the drive state of the engine 11 to the normal state in a short period of time. It is to be noted that in the first embodiment, the processing shown in FIG. 3 corresponds to a fuel injection means; the processing shown in FIGS. 6 and 7 corresponds to a pressure fluctuation calculation means; and processing shown in FIG. 8 corresponds to a means for deciding whether or not gas is present in the fuel pipe 24.

There is a possibility that the actual fuel pressure Pf drops during the injection of the fuel, depending on the characteristic of the engine 11, as shown in FIG. 5C1. In such a case, the normal-time fuel pressure POPN at the time when the pulse is ON and OFF may be calculated, respectively to compare the normal-time fuel pressure POPN with the drop-time fuel pressure PBOT when the pulse is OFF and compare the normal-time fuel pressure POPN with the rise-time fuel pressure PTOP when the pulse is ON. This method is more favorable than the above-described method because the fluctuation amount of the actual fuel pressure Pf becomes greater and thus a decision on whether vapor is present in the fuel pipe 24 can be more correctly made. In addition, because the normal-time fuel pressure POPN is steady, it is possible to obtain the normal time-fuel pressure POPN by calculating the average of a plurality of a predetermined number of the actual fuel pressures Pf detected when it is decided as YES at step. 322. In particular, when the actual fuel pressure Pf drops in the fuel supply line having a small volume during the fuel injection, the above-described processings are essentially required to determine the normal-time fuel pressure POPN.

In addition to the use of the two-dimensional map described previously, the correction value Vfpci may be determined according to a variation in the injection quantity of fuel (=te×N, where te is required pulse width and N is engine speed). In this case, the correction value Vfpci is set to be greater, as the variation of te×N increases.

| Variation in injection quantity (1/h) | 0 | 5 | 10 | 15 | 20 |
|---|---|---|---|---|---|
| Correction value Vfcpi (V) | 0 | 0.2 | 0.4 | 0.6 | 0.8 |

In the fuel supply system in accordance with the first embodiment, because the differential pressure sensor 28 for detecting the fuel pressure inside the fuel pipe 24 is located downstream the fuel filter 25, the differential pressure sensor 28 is capable of detecting the fuel pressure with high accuracy without being affected by the influence of pressure loss. Further, paying attention to the fact that the fuel pressure drops greatly due to the fuel injection, with the increase in the load applied to the engine, the correction value to be used in the fuel pressure feedback control is altered, based on the fuel pressure which changes according to the load applied to the engine. Thus, the response performance in the fuel pressure control is favorable and the fuel pressure can be stabilized. Furthermore, because the pulse width is corrected, according to the fuel pressure detected by the differential pressure sensor 28, the injection quantity of the fuel can be prevented from being subjected to the influence of a fluctuation in the fuel pressure. Thus, the injection quantity (air-fuel ratio) of the fuel can be prevented from deviating from a predetermined one.

Based on values determined by executing averaging processing of fuel pressures detected by the fuel pressure sensor 28, the voltage to be applied to the DC motor 26 is controlled and the pulse width is corrected. The averaging processing adopted to stabilize the fuel pressure and secure a necessary injection quantity of the fuel removes the influence of a fuel pressure fluctuation which occurs at a high frequency at the time of the fuel injection, thus providing a stable control of the fuel pressure and the injection quantity of the fuel.

In executing the averaging processing of the fuel pressures detected by the differential pressure sensor 28, a value to be used to control the voltage to be applied to the DC motor 26 is obtained by averaging the fuel pressures in a less fine degree than a value to be used to correct the pulse width. In this manner, the voltage to be applied to the DC motor 26 can be accurately controlled, i.e., a stable control of the fuel pressure can be assured and further, the pulse width can be rapidly changed according to a fluctuation in the fuel pressure, i.e., a stable control of the injection quantity of the fuel can be ensured.

The fuel pipe 24 terminates with a delivery pipe for distributing the fuel to the injectors. That is, the fuel supply system is not provided with a return pipe for returning a part of the fuel fed to the injector to the fuel tank 21, thus allowing the fuel supply line to have a simple construction. Thus, the present invention provides the fuel supply system space-saved and uncostly. Although the fuel supply system is not provided with the return pipe, the injection quantity of the fuel can be prevented from being subjected to the influence of a fluctuation in the fuel pressure, owing to a stable feedback control of the fuel pressure and a reliable control of the injection quantity of the fuel.

Figure 10:
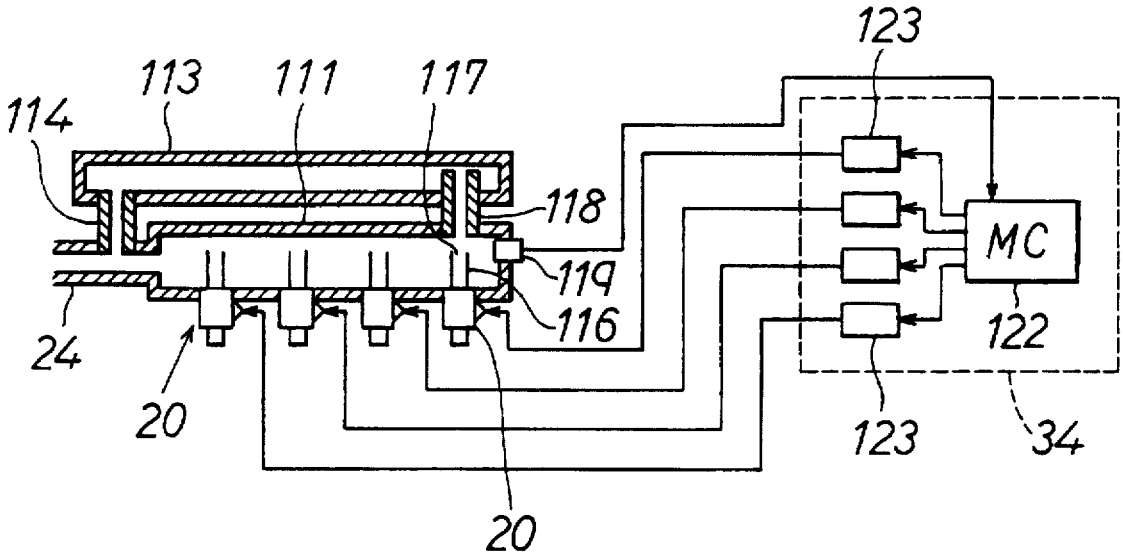
FIG. 10 is an explanatory view showing the construction in the periphery of a fuel injection valve of a fuel supply system in accordance with a second embodiment of the present invention.

A fuel supply system in accordance with the second embodiment is described below with reference to FIG. 10 showing the construction in the periphery of a fuel injector 20 of the fuel supply system. In the second embodiment, the fuel supply system is applied to a four-cylinder engine. The fuel supply system has a construction similar to that in accordance with the first embodiment, except the section shown in FIG. 10.

As shown in FIG. 10, a fuel delivery pipe 111 is connected with the fuel pipe 24 at the leading end thereof. The fuel delivery pipe 111 is horizontally provided above the intake pipe 15. Fuel is supplied to the engine 11 from the fuel tank 21 via the fuel pipe 24. An auxiliary delivery pipe 113 is provided above and in parallel with the fuel delivery pipe 111. The auxiliary delivery pipe 113 is connected with the fuel pipe 24 on the upstream side of the fuel delivery pipe 111 via a branch pipe 114.

Four fuel injectors 20 for injecting the fuel to an intake manifold of each cylinder #1 through #4 (not shown in FIG. 10) of the engine 11 are installed on the lower surface of the fuel delivery pipe 111 via each cylindrical connector 116. Each connector 116 extends to an upper space inside the fuel delivery pipe 111. A fuel intake port 117 at the upper end of each connector 116 is located in an upper space inside the fuel delivery pipe 111. The fuel delivery pipe 111 and the auxiliary delivery pipe 113 communicate with each other via a restrictor or throttle pipe 118. The throttle pipe 118 is positioned immediately above the fuel injector 20 farthest from the branch pipe 114 and extends to an upper space inside the auxiliary delivery pipe 113. This construction allows fuel vapor collected in the upper space inside the auxiliary delivery pipe 113 to be easily drawn into the connector 116 of the fuel injector 20 via the throttle pipe 118. The fuel delivery pipe 111 is provided with a pressure sensor 119 for detecting an absolute pressure of the fuel present inside the fuel delivery pipe 111.

The construction of the electronic control circuit 34 for controlling each fuel injector 20 is described below. The electronic control circuit 34 comprises a microcomputer 122 having a CPU, a ROM, and a RAM. The microcomputer 122 outputs signals to four drive circuits 123 to drive the four fuel injectors 20 independently of each other. The electronic control circuit 34 receives signals outputted from the pressure sensor 119, the air flow meter 18, the rotation sensor 41, the water temperature sensor 40, and the intake air temperature sensor 42.

The electronic control circuit 34 executes independent fuel injection, group injection or simultaneous injection, depending on the drive state of the engine 11. In the independent injection, when one of the cylinders #1 through #4 has started an intake process, the fuel injector 20 corresponding to the cylinder which has started the intake process is selectively driven so that the fuel injector 20 injects the fuel thereto. In the group injection, the fuel is injected to two groups of cylinders each consisting of two cylinders, alternately at an interval of 360° CA (crank angle). In the simultaneous injection, the fuel is simultaneously injected to all of the four cylinders #1 through #4 at an interval of 720° CA. Because the processing of switching the three manners of fuel injection to be executed when gas is not present in the fuel pipe 24 is known, the fuel delivery pipe 111, and the auxiliary delivery pipe 113 (hereinafter referred to as fuel supply line), the description thereof is omitted herein. Thus, the processing of switching the three manners of fuel injection to be executed when gas is present therein is described below.

The flag fR is also set in the second embodiment so that the electronic control executes gas detection processing similar to the processings shown in FIGS. 6 through 8. In the second embodiment, the pressure sensor 119 detects the absolute pressure, inside the fuel delivery pipe 111, which changes in the manner as shown in FIGS. 5A1 and 5B1 indicating the change of the actual fuel pressure Pf inside the fuel pipe 24. Accordingly, the flowcharts shown in FIGS. 6 through 8 are applicable to the second embodiment by merely altering the predetermined values $K_1$ and $K_2$ of the first embodiment.

Because the throttle pipe 118 communicates with the fuel delivery pipe 111 and the auxiliary delivery pipe 113 positioned immediately above the fuel delivery pipe 111, fuel vapor generated inside the fuel delivery pipe 111 when the engine 11 is not in operation is collected into the auxiliary delivery pipe 113 via the throttle pipe 118 and stays in an upper space inside the auxiliary delivery pipe 113. In order to discharge the vapor from the auxiliary delivery pipe 113, a great amount of fuel should be discharged from the auxiliary delivery pipe 113 by driving the fuel injection valve 20, and the pressure difference between the gas pressure inside the auxiliary delivery pipe 113 and the fuel pressure inside the fuel delivery pipe 111 at the time of a fuel injection should be set to be great.

In the processing of switching the three manners of the fuel injection in accordance with the second embodiment, when gas has entered the fuel supply line, the independent injection is switched to the group injection or the group injection is switched to the simultaneous injection so as to obtain a state in which at a one-time fuel injection, a great amount of fuel is discharged and the drop degree of the fuel pressure is great. In switching the independent injection to the group injection, two fuel injection valves 20 are simultaneously driven in the one-time fuel injection. Similarly, in switching the group injection to the simultaneous injection, four fuel injection valves 20 are simultaneously driven in the one-time fuel injection. As a result, after the independent injection is switched to the group injection at a point t1 or after the group injection is switched to the simultaneous injection at a point t1, the drop degree of the fuel pressure becomes much greater, and thus the pressure difference between the gas pressure and the fuel pressure increases to a great extent. Consequently, the discharge amount of the fuel in the one time-fuel injection increases greatly as shown in FIGS. 11A through 11J and hence, vapor can be effectively discharged from the auxiliary delivery pipe 113 in a very short period of time. FIGS. 11A through 11E show a case in which the independent injection is switched to the group injection. FIGS. 11F through 11J show a case in which the group injection is switched to the simultaneous injection.

Figure 12:
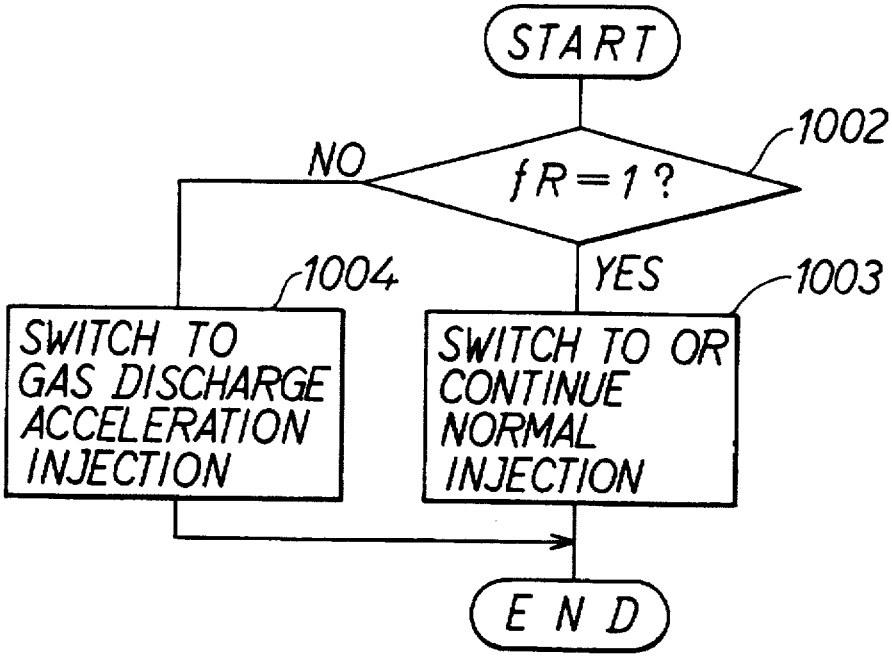
FIG. 12 is a flowchart showing injection methods-switching processing in accordance with the second embodiment.
Figure 13:
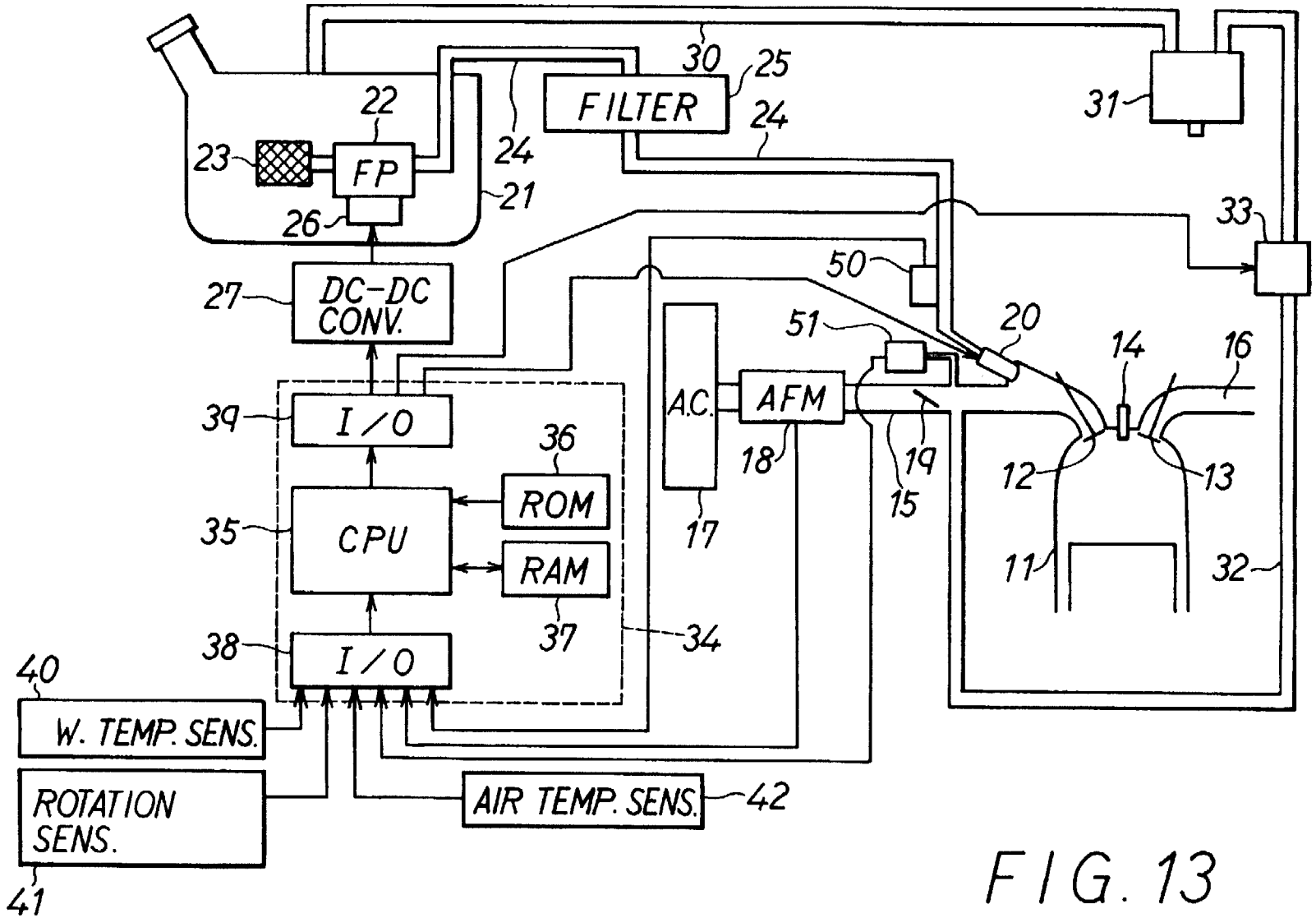
FIG. 13 is a schematic block diagram showing the construction of an entire fuel supply system in accordance with a third embodiment of the present invention.

FIG. 12 is a flowchart showing the fuel injection switching processing in accordance with the second embodiment. The electronic control circuit 34 executes processing shown in FIG. 12 repeatedly at an interval of a predetermined time period or at an interval of a predetermined number of rotations of the engine 11.

Upon start of processing, initially, it is decided at step 1002 whether or not the flag fR is set to "1". If YES at step 1002, i.e., if it is decided that air or vapor is not present in the fuel supply line, the program goes to step 1003 and then, the electronic control circuit 34 terminates processing. At step 1003, the normal-time injection method, namely, the injection method to be carried out when gas is not present in the fuel supply line is selected in correspondence to the drive state of the engine 11 or the normal-time injection method continues if the normal-time injection method is currently in execution. If NO at step 1002, i.e., if it is decided that air or vapor is present in the fuel supply line, the program goes to step 1004 at which the fuel injection method is switched from the normal-time injection method to a gas discharge acceleration method which is described below. Then, the electronic control circuit 34 terminates the processing. That is, when the independent injection is selected in the normal-time injection method, the independent injection is switched to the group injection; and when the group injection is selected in the normal-time injection method, the group injection is switched to the simultaneous injection.

The injection method switching process in accordance with the second embodiment allows gas to be discharged effectively in a short period of time. Accordingly, even though gas is present in the fuel supply line, the drive state of the engine 11 can be returned to the normal state in a short period of time.

When the independent injection is switched to the simultaneous injection, the four fuel injection valves 20 are driven simultaneously in a single time injection. Consequently, as shown in FIGS. 11K through 110, the fuel pressure drops greatly, and as a result, the gas can be effectively discharged. Thus, at step 1004, the independent injection may be switched to the simultaneous injection. Depending on the fluctuation amount (for example, value corresponding to PTOP–POPN and POPN–PBOT) of the fuel pressure at the time when the fuel injection valve 20 is opened and closed, the independent injection is switched to the group injection or to the simultaneous injection.

In the second embodiment, the fuel supply system is applied to a four-cylinder engine, but may be applied to an engine comprising five or more cylinders. For example, if the fuel supply system is applied to a six-cylinder engine, the group injection may be carried out by dividing the six cylinders into two or three groups. If the fuel supply system is applied to a multi-cylinder engine and the group injection is selected in the normal-time injection method, more fuel injection valves 20 can be driven simultaneously in a one-time fuel injection by switching the number of groups.

In the second embodiment, the auxiliary delivery pipe 113 is provided above and in parallel with the fuel delivery pipe 111, and the fuel delivery pipe 111 and the auxiliary delivery pipe 113 communicate with each other via the throttle pipe 118 so as to collect vapor in the auxiliary delivery pipe 113. It is, however, possible to omit the provision of the auxiliary delivery pipe 113 and increase the capacity of the fuel delivery pipe 111 so as to collect air or vapor in the upper space inside the fuel delivery pipe 111. In the second embodiment, the connector 116 of each fuel injection valve 20 extends to the upper space inside the fuel delivery pipe 111 to discharge air or vapor therethrough, but all the connectors 116 are not extended to the upper space inside the fuel delivery pipe 111.

Instead of the differential pressure sensor 28 used in the first embodiment, a fuel sensor 50 for detecting the absolute pressure of the fuel pressure may be mounted on the fuel pipe 24 and a pressure sensor 51 may be mounted on the intake pipe 15 so as to determine the differential pressure (fuel pressure), based on the absolute pressure of the fuel pressure and the pressure of air inside the intake pipe 15.

Figure 14:
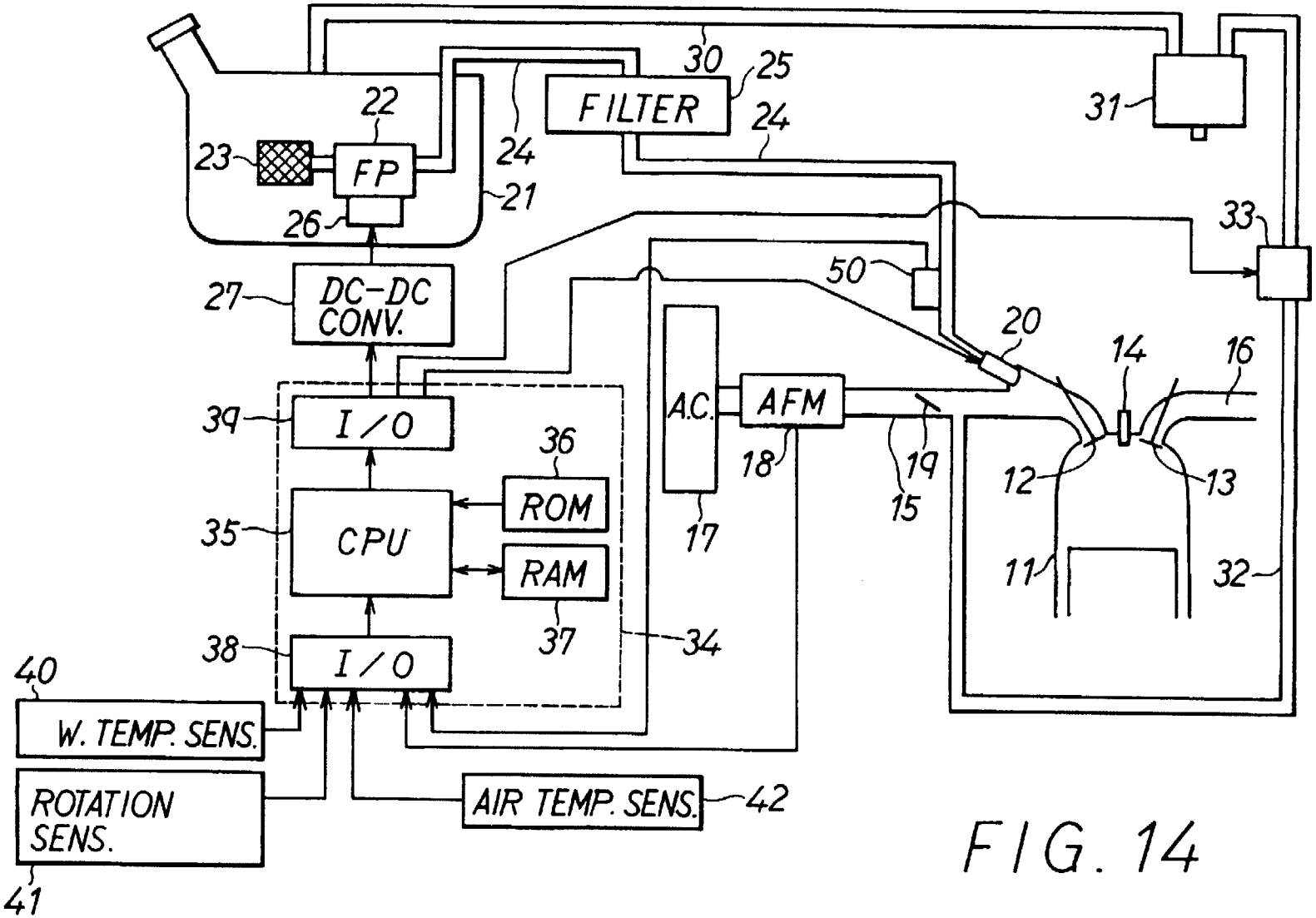
FIG. 14 is a schematic block diagram showing the construction of an entire fuel supply system in accordance with a fourth embodiment of the present invention.
Figure 17A:
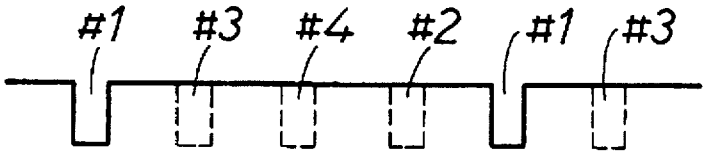
FIG. 17A PRIOR ART
FIGS. 17A and 17B are time charts showing how a fuel pressure fluctuates when fuel is injected in a conventional fuel supply system.
Figure 17B:
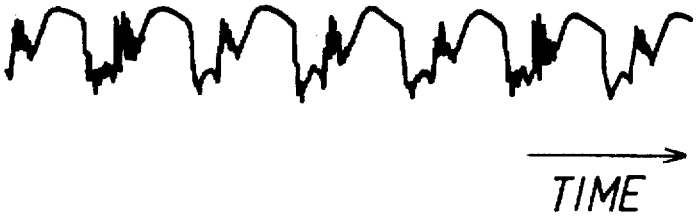
FIG. 17B PRIOR ART
Figure 18:
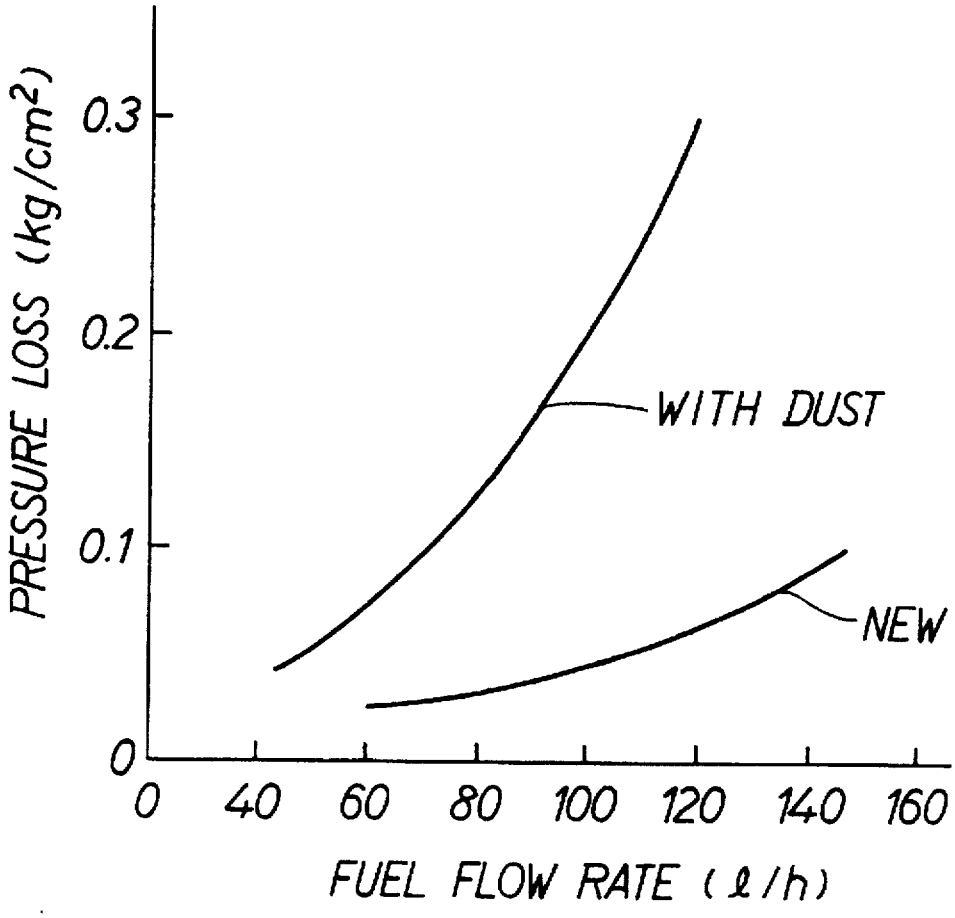
FIG. 18 PRIOR ART
FIG. 18 is a view showing the characteristic of pressure loss generated by a fuel filter provided in a fuel supply line of a conventional fuel supply system.

The pressure sensor 51 may be eliminated from the fuel supply system. In this case, the differential pressure (fuel pressure) may be determined based on the difference between the absolute pressure of the fuel pressure detected by the fuel sensor 50 and the pressure, inside the intake pipe 15, estimated based on information which is obtained by using a two-dimensional map shown in FIG. 14, based on the intake air quantity detected by the air flow meter 18 and the engine speed detected by the rotation sensor 41. Alternatively, the basic pulse width tp and the open degree of the throttle valve 19 may be used instead of the intake air quantity.

Figure 4:
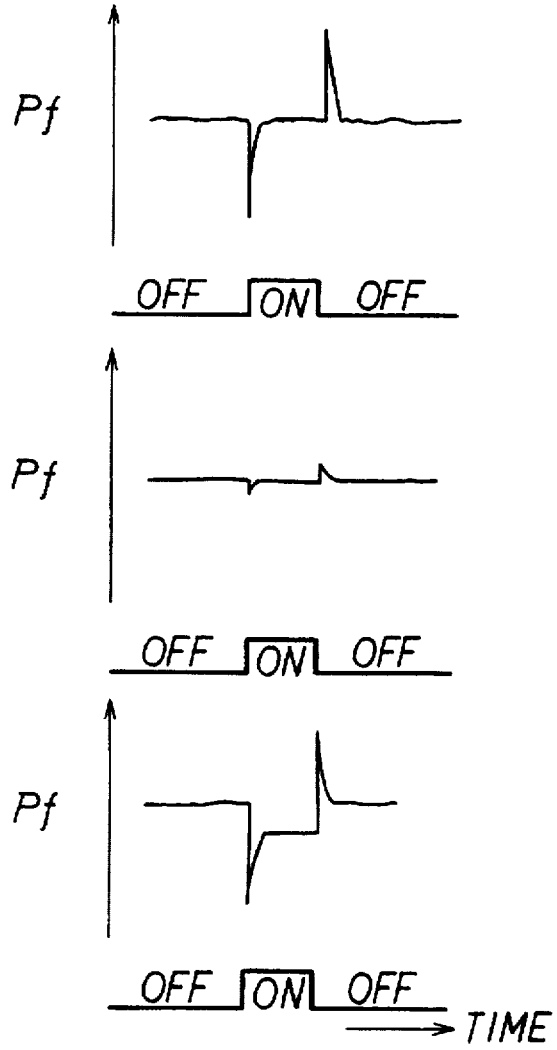
FIG. 4 is a view showing a three-dimensional map for determining a correction value Vfpci to be used in a fuel pressure feedback control, based on a load applied to an engine, namely, the ratio of an intake air quantity (Q) to an engine speed (N) and the engine speed (N)

In the first embodiment, the three-dimensional map shown in FIG. 4 is used to determine the correction value Vfpci to be used in feedback control to be performed for adjustment of the fuel pressure, based on the load applied to the engine 11, namely, the ratio of the intake air quantity (Q) to the engine speed (N) and the engine speed (N). In addition, it is possible to use a fuel injection quantity (=te×N) as the data of the load applied to the engine 11 to determine the correction value Vfpci, according to a variation in the fuel injection quantity which is varied according to the load applied to the engine 11. As shown in FIG. 16, the correction value Vfpci should be set to a greater value as the variation in the fuel injection quantity (=te×N) increases.

In the embodiments, the voltage to be applied to the DC motor 26 of the fuel pump 22 via the DC—DC converter 27 is adjusted to control the fuel pressure. Alternatively, it is possible to use PWM (pulse width modulation) control method used to change an average voltage by adjusting the rate of power supply to be applied to the motor 26 so as to control the discharge pressure (fuel pressure) of the fuel pump 22.

In the embodiments, the variable-speed motor is controlled to control the fuel pressure. It is, however, possible to control other components in the fuel supply pipe, such as a conventional fuel pressure regulating valve disposed in the fuel pipe.

Air or vapor can be forcibly discharged or eliminated from the fuel supply line in repairing vehicles carrying the engine 11 by providing a test terminal thereon. That is, the electronic control circuit 34 sets the flag fR to "0" forcibly when the test terminal is turned on. In stead of the gas-discharging construction, the fuel supply system may be provided with an abnormality informing means such as an EMG lamp for informing an operator of the occurrence of abnormality when vapor is detected (flag fR=0) in the fuel supply system.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A fuel supply system of an internal combustion engine for feeding, under pressure, fuel stored inside a fuel tank by means of a fuel pump to an injector through a fuel pipe and a fuel filter and injecting the fuel to the internal combustion engine from the injector, the system comprising:

a speed variable driving means for speed-variably controlling a discharge pressure of the fuel pump;

a fuel pressure detection means positioned downstream the fuel filter for detecting a fuel pressure inside the fuel pipe;

a pulse width correction means for correcting a width of a pulse to be applied to the injector, according to the fuel pressure detected by the fuel pressure detection means; and a fuel pressure control means for controlling the speed-variable driving means by feedback, based on the fuel pressure detected by the fuel pressure detection means so that the fuel pressure coincides with a target-pressure, the fuel pressure control means including a means for correcting a correction value to be used to control the speed-variable driving means by the feedback, according to a load applied to the internal combustion engine.

2. The fuel supply system of the internal combustion engine according to claim 1, wherein the fuel pressure control means controls the speed-variable driving means and the pulse width correction means corrects the pulse width, based on an average value of the fuel pressures detected by the fuel pressure detection means.

3. The fuel supply system of the internal combustion engine according to claim 2, wherein the average value of the fuel pressures detected by the fuel pressure detection means is set differently by averaging in different degrees to be used to control the speed-variable driving means and to be used to correct the pulse width.

4. The fuel supply system of the internal combustion engine according to claim 1, wherein the fuel pipe is in a nonreturn-type construction terminating with a delivery pipe for distributing the fuel to the injector.

5. A fuel supply system of an internal combustion engine comprising:

a fuel supply means for feeding fuel via a fuel supply pipe;

a fuel pressure detection means for detecting a pressure of the fuel present inside the fuel supply pipe;

a fuel injection means for injecting the fuel supplied thereto via the fuel supply pipe to each cylinder of the internal combustion engine by opening and closing a fuel injection valve synchronously with the rotation of the internal combustion engine;

a pressure fluctuation calculation means for calculating a fluctuation amount of the pressure detected by the fuel pressure detection means when the fuel injection valve is opened or closed by the fuel injection means; and a gas presence/absence decision means for deciding whether gas is present in the fuel supply pipe, based on the fluctuation amount of the pressure calculated by the pressure fluctuation calculation means.

6. The fuel supply system of the internal combustion engine according to claim 5, wherein the fuel supply means increases the pressure of fuel when the gas presence/absence decision means decides that gas is present in the fuel supply pipe.

7. The fuel supply system of the internal combustion engine according to claim 5, wherein the number of the fuel injection valves is plural; and the fuel injection means increases the number of the fuel injection valves which are opened simultaneously when the gas presence/absence decision means decides that gas is present in the fuel supply pipe.

* * * * *